US007872617B2

(12) United States Patent
Yamashita et al.

(10) Patent No.: US 7,872,617 B2
(45) Date of Patent: Jan. 18, 2011

(54) DISPLAY APPARATUS AND METHOD FOR DRIVING THE SAME

(75) Inventors: Takanori Yamashita, Yokohama (JP); Somei Kawasaki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1139 days.

(21) Appl. No.: 11/539,442

(22) Filed: Oct. 6, 2006

(65) Prior Publication Data

US 2007/0132719 A1 Jun. 14, 2007

(30) Foreign Application Priority Data

Oct. 12, 2005 (JP) ..... 2005-297641

(51) Int. Cl.
*G09G 3/32* (2006.01)

(52) U.S. Cl. ..... 345/76; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 5,933,033 | A | 8/1999 | Shima | 327/105 |
| 6,858,991 | B2 * | 2/2005 | Miyazawa | 315/169.3 |
| 7,154,456 | B1 * | 12/2006 | Saito | 345/77 |
| 7,242,397 | B2 | 7/2007 | Iseki et al. | 345/204 |
| 7,508,363 | B2 | 3/2009 | Hashimoto | |
| 7,532,207 | B2 | 5/2009 | Kawasaki et al. | |
| 7,646,362 | B2 * | 1/2010 | Mizukoshi et al. | 345/76 |
| 2001/0033258 | A1 * | 10/2001 | Berryman et al. | 345/72 |
| 2003/0071576 | A1 * | 4/2003 | Koyama | 315/169.3 |
| 2003/0122813 | A1 * | 7/2003 | Ishizuki et al. | 345/211 |
| 2003/0197665 | A1 * | 10/2003 | Sung | 345/82 |
| 2004/0183752 | A1 | 9/2004 | Kawasaki et al. | 345/20 |
| 2004/0233142 | A1 * | 11/2004 | Matsumoto et al. | 345/76 |
| 2005/0001795 | A1 * | 1/2005 | Kitahara | 345/76 |
| 2005/0122150 | A1 | 6/2005 | Iseki et al. | 327/215 |

(Continued)

FOREIGN PATENT DOCUMENTS

JP 08-256059 A 10/1996

(Continued)

*Primary Examiner*—Alexander Eisen
*Assistant Examiner*—Nelson Lam
(74) *Attorney, Agent, or Firm*—Fitzpatrick, Cella, Harper & Scinto

(57) ABSTRACT

A display apparatus includes a matrix display unit including light-emitting devices that emit light of one of a plurality of colors with a brightness corresponding to a current and pixel circuits that drive the light-emitting devices, a plurality of column control circuits that receive input image signals and generate and output current-data signals, and a plurality of data lines each provided for each column of the matrix display unit to transfer the current-data signal output from the column control circuit to one of the pixel circuits in the column. The light-emitting devices have different current-luminance efficiencies depending on colors of emitted lights, and the plurality of data lines are divided into sets of data lines, each set of data lines transferring the current-data signals of the plurality of colors to the pixel circuits, and the number of data lines in the set of data lines is equal to the number of colors. In addition, one set of the column control circuits, comprised of a number larger than a number of colors of the display unit, is provided for one set of the data lines, comprised of a number equal to the number of colors.

5 Claims, 6 Drawing Sheets

U.S. PATENT DOCUMENTS

| | | | | |
|---|---|---|---|---|
| 2005/0174306 | A1* | 8/2005 | Agari et al. | 345/76 |
| 2006/0055639 | A1* | 3/2006 | Yamada | 345/77 |
| 2006/0114194 | A1 | 6/2006 | Kawasaki et al. | 345/76 |
| 2006/0114195 | A1 | 6/2006 | Yamashita et al. | 345/76 |
| 2006/0132395 | A1 | 6/2006 | Kawasaki et al. | 345/75.2 |
| 2007/0132719 | A1 | 6/2007 | Yamashita et al. | 345/156 |
| 2008/0157828 | A1 | 7/2008 | Kawasaki et al. | |
| 2008/0158112 | A1 | 7/2008 | Kawasaki et al. | |
| 2009/0066613 | A1 | 3/2009 | Nakamura et al. | |

FOREIGN PATENT DOCUMENTS

| | | | |
|---|---|---|---|
| JP | 2003-058108 | A | 2/2003 |
| JP | 2004-183752 | | 7/2004 |
| JP | 2004-295081 | A | 10/2004 |
| JP | 2005-115287 | A | 4/2005 |
| JP | 2007-133351 | A | 5/2007 |

* cited by examiner

DISPLAY APPARATUS AND METHOD FOR DRIVING THE SAME

BACKGROUND OF THE INVENTION

1. Field of the Invention

The present invention relates to display apparatuses in which electroluminescent (EL) devices that emit light depending on an input current are arranged in a matrix and to methods for driving the display apparatuses. More specifically, the present invention relates to an active-matrix display apparatus including current-driven light-emitting devices and current-programmed pixel circuits and to a current supplying method for the display apparatus.

2. Description of the Related Art

Recently, self-illuminating displays including light-emitting devices have attracted attention as next-generation displays. In particular, organic EL devices, which are current-controlled light-emitting devices whose illumination brightness is controlled by a current flowing in the devices, have been extensively applied and developed.

In color organic EL displays, a set of light-emitting devices of three primary colors of red (R), green (G), and blue (B) that are disposed side by side is used as a unit to display one color, and such light-emitting devices are arranged in rows and columns to form a matrix display apparatus. The light-emitting device of each of RGB colors is made of an EL material that emits light having a wavelength of the corresponding color.

There are variations in illumination brightness between the respective colors even when the same current flows. In organic EL materials available for practical use, a light-emitting material for blue (B) exhibits a lower current-luminance efficiency characteristic than that for red (R) and green (G). The current-luminance efficiency is defined as the ratio of the current per unit area ($A/m^2$) to the luminance ($cd/m^2$).

In organic EL panels, a large amount of current is supplied to light-emitting devices having a low current-luminance efficiency to obtain an RGB-balanced illumination brightness. It is therefore attempted to increase the amplitude of input image signals of the low-current-luminance-efficiency light-emitting devices compared with the light-emitting devices of the remaining colors or to increase the voltage-current conversion gain of a current-data generation circuit only for the low-current-luminance-efficiency light-emitting devices so that a large amount of current can flow in the pixels of the corresponding color.

However, if uniform brightness is achieved by correcting the amplitude of the input image signals, the amplitude will be largely corrected to significantly increase the signal voltage of the specific color, and the power supply voltage of a modifying circuit needs to increase correspondingly, which is undesirable. In view of a low power supply voltage required for the power supply of a controller IC that controls the amplitude of the input image signals, it is difficult to increase the amplitude of the input image signals.

Further, if the voltage-current conversion gain of the current-data generation circuit is increased for a specific color, there is no compatibility between current generation circuits of different colors. Thus, the pattern of the current generation circuits needs to be changed for a different color arrangement of a display section.

SUMMARY OF THE INVENTION

The present invention provides a display apparatus capable of supplying a desired current to each pixel column without increasing the amplitude of an input image signal and without reducing the display quality, and a method for driving the display apparatus.

According to an aspect of the present invention, a display apparatus includes a matrix display unit including light-emitting devices that emit light of one of a plurality of colors with a brightness corresponding to a current and pixel circuits that drive the light-emitting devices, the light-emitting devices and the pixel circuits being arranged in rows and columns; a plurality of column control circuits that receive input image signals and generate and output current-data signals; and a plurality of data lines each provided for each column of the matrix display unit to transfer the current-data signal output from the column control circuit to one of the pixel circuits in the column.

The plurality of data lines are divided into sets of data lines, each set of data lines transferring the current-data signals of the plurality of colors to the pixel circuits, and the number of data lines in the set of data lines being equal to the number of colors.

The plurality of column control circuits are divided into sets of column control circuits, each set of column control circuits outputting the current-data signals to each of the sets of data lines, the number of column control circuits in each of the sets of column control circuits being larger than the number of colors.

Each of the sets of column control circuits includes at least a column control circuit unit connected to one of the data lines that transfers the current-data signal of a predetermined color of the plurality of colors to one of the pixel circuits and a number of column control circuit units commonly connected to one of the data lines that transfers the current-data signal of another color of the plurality of colors to one of the pixel circuits to output a sum of the current-data signals of the column control circuits to the connected data line, the number of the column control circuit units commonly connected to one of the data lines that transfers the current-data signal of the another color of the plurality of colors being larger than the number of the at least a column control circuit unit connected to one of the data lines that transfers the current-data signal of the predetermined color of the plurality of colors.

According to the present invention, a display apparatus capable of supplying a desired current to each pixel column without increasing the amplitude of an input image signal and without reducing the display quality, and a method for driving the display apparatus can be provided.

The present invention relates to a current programming apparatus, an active-matrix display apparatus, and a current supplying method for those apparatuses. More specifically, the present invention provides an active-matrix display apparatus including current-driven light-emitting devices. The active-matrix display apparatus can be used to construct, for example, an information display apparatus. The information display apparatus is in the form of, for example, a cellular phone, a portable computer, a still camera, or a video camera. Alternatively, the information display apparatus is an apparatus capable of achieving a plurality of the functions realized by those apparatuses. The information display apparatus is provided with an information input unit. For example, in the case of a cellular phone, the information input unit includes an antenna. In the case of a personal digital assistant (PDA) or a portable personal computer (PC), the information input unit includes an interface unit that is used to connect to a network. In the case of a still camera or a movie camera, the information input unit includes a charge-coupled device (CCD) or complementary metal-oxide semiconductor (CMOS) sensor unit.

Further features of the present invention will become apparent from the following description of exemplary embodiments with reference to the attached drawings.

DESCRIPTION OF THE EMBODIMENTS

Figure 1:
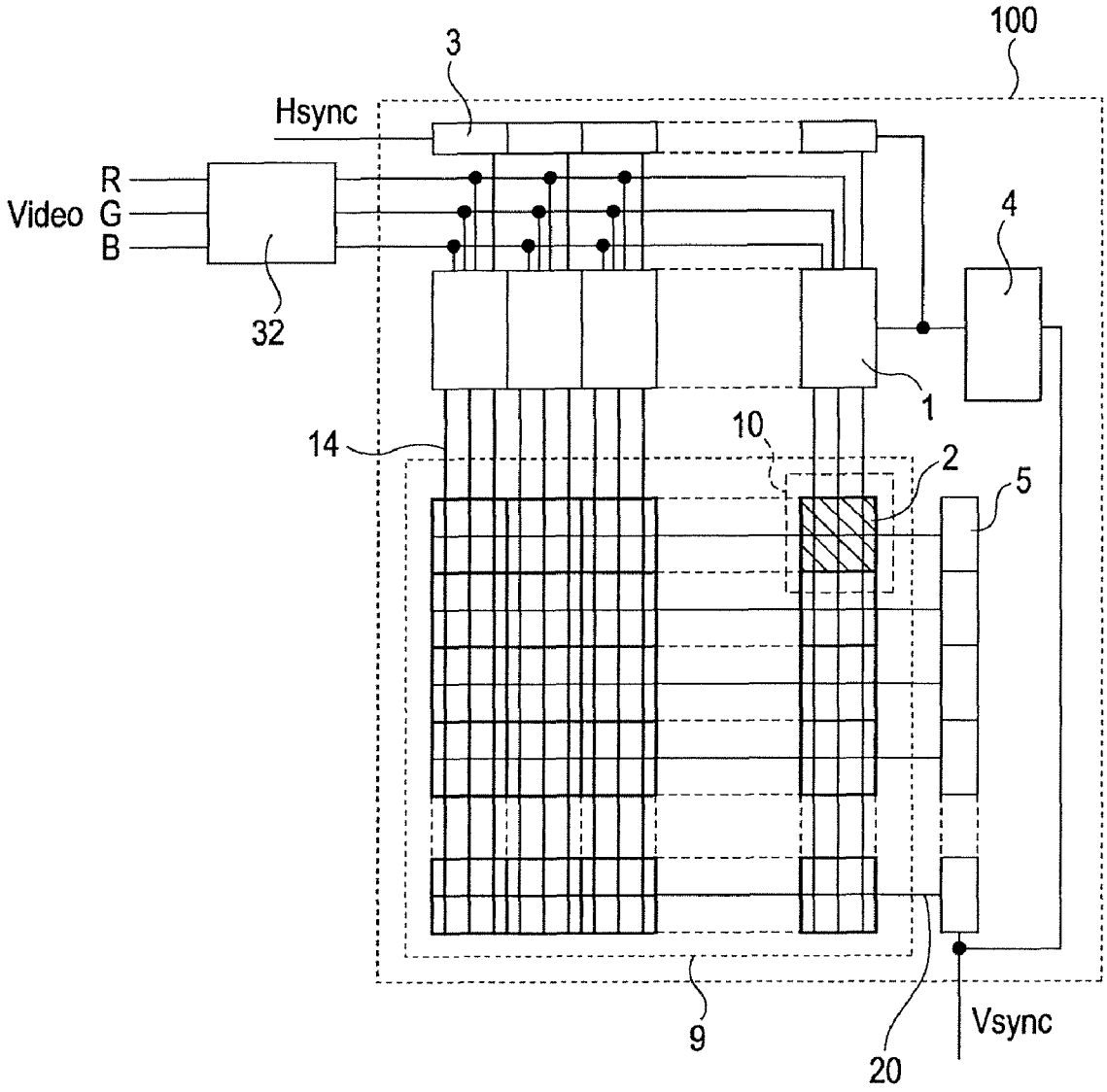
FIG. 1 is a diagram showing an overall structure of a display apparatus according to a first embodiment of the present invention.

A display apparatus according to an embodiment of the present invention will be described. The embodiment will be described in the context of an active-matrix display apparatus including EL devices.

The display apparatus according to the embodiment is an organic EL display that includes light-emitting devices having different current-luminance efficiencies for different colors. The organic EL display includes column control circuits having a substantially uniform voltage-current conversion efficiency, the number of which is larger than the number of data lines. Two or more column control circuits are connected to a column associated with the color having the lowest current-luminance efficiency.

In an organic EL display including light-emitting devices of three RGB colors, if the current-luminance efficiency of the red and green light-emitting devices is two times larger than that of the blue light-emitting devices, four column control circuits are provided for one set of RGB data lines. A current is supplied from one of the column control circuits to each of the red and green data lines, and the remaining two column control circuits are commonly connected to the blue data line.

The same applies to a case in which the number of colors is three or more. One column control circuit is connected to one data line of a color having a high current-luminance efficiency, and two or three column control circuits are commonly connected to a data line of a color having a low current-luminance efficiency to supply a current that is twice or three times larger.

If a required current of a color having lower current-luminance efficiency is 1.5 times larger than the current of a color having higher current-luminance efficiency, two column control circuits are connected to the data lines of the color having higher current-luminance efficiency, and three column control circuits are connected to the data lines of the color having low current-luminance efficiency.

The number of the column control circuits connected to a data line is suitably determined. Thus, uniform brightness can be achieved for the respective colors.

If the current-luminance efficiency ratio is not an integer, two or more column control circuits are connected to a data line of a color having a low current-luminance efficiency to achieve uniform brightness to some extent, and, in addition, the amplitude of an input image signal is corrected for each of the colors. As previously described, it is not desirable to achieve uniform brightness on the basis of only the amplitude of input signals because the signal voltage of a specific color is significantly increased. By using this method in a combination with the method of the present invention in which two or more column control circuits are commonly used, the current-output brightness can be made uniform with less correction.

Even if all column control circuits are designed so as to have the same characteristics, due to the characteristic variations of elements constituting the column control circuits, which are thin-film transistors (TFTs), the output chrematistics of the column control circuits vary. In order to effectively hide the variations from the view, as proposed in U.S. Pat. No. 5,933,033, one set of column control circuits and one set of data lines may be connected by a switch, and the connection may be switched every predetermined period. Thus, the variations in the output characteristics of the same set of column control circuits are averaged. The predetermined period may be sufficiently rapid so that the switching is not directly visible but the variations can be averaged. The predetermined period may be a 1H period (unit horizontal-line period), a 1F period (unit frame period), an intermediate sub-frame period (½F period), or any other period.

In accordance with the above-described switching of the connection between the column control circuits and the data lines, the input of each of the column control circuits is also switched so that a current-data signal of a color is constantly supplied to each of the data lines. Thus, the pixel connected to the data line receives the current-data signal of the same color as the light-emitting device in the pixel.

Another method for compensating for the variations in the output characteristics of the column control circuits is proposed in U.S. Patent Laid-Open No. 2004-0183752. According to the proposed method, column currents may be detected one-by-one in one set, and an input image signal may be further corrected accordingly.

First Embodiment

FIG. 1 shows an overall structure of a display apparatus 100 according to a first embodiment of the present invention.

The display apparatus 100 includes light-emitting devices and circuits that are formed on a single substrate. A data modifying circuit 32 for correcting the amplitude of an input image signal Video is provided outside the display apparatus 100.

The display apparatus 100 includes a matrix display area 9 that is formed by arranging EL display devices EL 10 and pixel circuits 2 that drive the EL display devices EL in rows and columns. In FIG. 1, each of the pixel circuits 2 is a circuit that drives the EL display device of any of RGB colors.

When the EL display devices used in the first embodiment display white with a luminance of 500 cd/m$^2$ by turning on all pixels, the following current densities of those pixels were obtained:

$$\text{R pixels: } 120\ \text{A/m}^2$$

$$\text{G pixels: } 187\ \text{A/m}^2$$

$$\text{B pixels: } 273\ \text{A/m}^2 \tag{1}$$

That is, in order to emit light with the maximum brightness, the smallest current is required by the R pixels, and, next by the G pixels. The largest current flows in the B pixels, which is twice or more times the current flowing in the R pixels. When displaying white color, the brightness values of the R, G, and B pixels are not necessarily the same, and are suitably set so as to have a brightness ratio that is determined in consideration of the white balance. Preferable values are shown above.

The matrix display area 9 is provided with scanning lines 20 for the individual rows, and data lines 14 for the individual columns. The display apparatus 100 further includes a scanning line driving circuit 5 and a column control circuit 1 around the display area 9. The scanning line driving circuit 5 outputs scanning signals to the scanning lines 20, and the column control circuit 1 generates current-data signals to be output to the data lines 14.

In the matrix display area 9, pixels of a same color are arranged in a column. In FIG. 1, one column of pixels is linearly arranged in a stripe. Alternatively, the matrix display area 9 may have a so-called delta arrangement in which the pixels are staggered on each row by 1.5-pixel pitch. It is not necessary that one column connected by one data line is constituted by EL devices of a same color. It is assumed that the three data lines are individually connected to one of the three light-emitting devices in a row.

The scanning line driving circuit 5 is a shift register that performs a shift operation in response to a vertical synchronization signal Vsync and that sequentially sends selection pulses to the scanning lines 20 to select rows. The scanning lines 20 may be selected one-by-one from the top. Alternatively, interlaced scanning may be performed in which every other line is selected, that is, an odd-numbered line is selected at the first vertical synchronization and an even-numbered line is selected at the second vertical synchronization. In the case of the interlaced scanning, two channels of shift registers may be provided and may be switched at every vertical synchronization.

The column peripheral circuitry of the display apparatus 100 includes, in addition to the column control circuit 1, a horizontal shift register 3 and a gate circuit 4 that supplies control signals to the horizontal shift register 3 and the column control circuit 1. The matrix display area 9 and the peripheral circuitry are formed of TFTs, and are integrally formed on a single substrate.

The horizontal shift register 3 performs a shift operation in response to a horizontal synchronization signal Hsync, and sequentially supplies sampling pulses to the column control circuit 1.

The image signal Video input from the outside is a parallel signal that is carried on three signal lines R, G, and B. The image data on each signal line is a serial signal, and is sequentially sampled by the column control circuit 1. The timing of sampling is determined by the sampling pulses output from the horizontal shift register 3.

The column control circuit 1 generates current data corresponding to the sampled video signals, and outputs the generated current data from an output terminal in synchronization with the selection of rows by the scanning line driving circuit (row control circuit) 5. In FIG. 1, the column control circuit 1 is illustrated as blocks each of which is associated with three columns of RGB colors. In practice, however, as described below, a plurality of column control circuits are provided.

Figure 2:
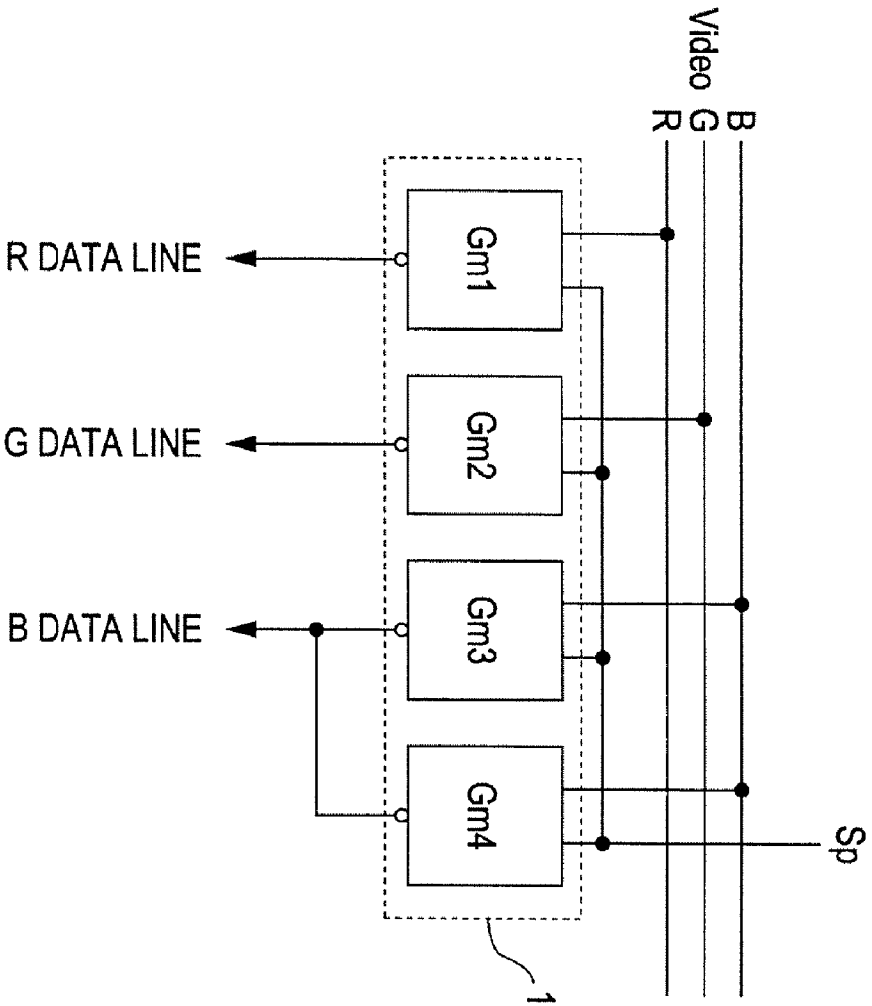
FIG. 2 is a diagram showing a structure of a set of column control circuit units in a column control circuit according to the first embodiment.

FIG. 2 is a diagram showing in detail one set of column control circuit units in the column control circuit 1, which is a feature of the present invention. In FIG. 1, one block of the column control circuit 1 includes a set of four column control circuit units. The set of column control circuit units receives an identical sampling pulse Sp from the horizontal shift register 3, and simultaneously samples image signals Video of three primary colors: red (R), green (G), and blue (B). Although only a first column of the column control circuit 1 is shown in FIG. 2, a plurality of columns are provided. The first column of the column control circuit 1 (including column control circuit units Gm1, Gm2, Gm3, and Gm4) and the first-column data line 14 (including an R data line, a G data line, and a B data line) supply current data to the three RGB pixels in the first column. The second column of the column control circuit 1 and the second-column data line 14 supply current data to the RGB pixels in the second column, and, likewise, current data is supplied to the RGB pixels in the subsequent columns.

In the first embodiment, R, G, B, and B image signals are input to one set of four column control circuit units Gm1, Gm2, Gm3, and Gm4 in the first column of the column control circuit 1, respectively. That is, an R image signal is input to the first column control circuit unit Gm1, a G image signal is input to the second column control circuit unit Gm2, and the same B image signal is input to the third and fourth column control circuit units Gm3 and Gm4.

Each of the column control circuit units generates a current-data signal with respect to the voltage of the input image signal. Since the column control circuit units are designed so as to have the same characteristics of the output current with respect to the input voltage, the B pixel column is supplied with a current-data signal that is twice that for the R and G pixel columns.

In order to emit light of a white-balanced color, the corrected image-signal amplitude obtained from the modifying circuit 32 is set to satisfy the expression below so that the RGB current ratio can have the above-mentioned values:

$$V_R:V_G:V_B=120:187:137 \quad (2)$$

Since two column control circuit units are provided for the B color, the current supplied by each of those column control circuit units can be reduced to half of the current value mentioned above. As a result, the corrected image-signal amplitude can also be reduced. This is the reason why the ratio of the image-signal amplitude of the B color in the above expression has a value that is half of a required current density of 273 $A/m^2$.

When the corrected image signals are sent to the column control circuit units, the output currents from the column control circuit units also have the same ratio as that shown above. By multiplying the current for the B color by two, the current ratio of the RGB columns is given as follows:

$$I_R:I_G:I_B=120:187:273 \quad (3)$$

Therefore, a white-balanced color can be reproduced.

The modifying circuit 32 stores correction coefficients kR, kG, and kB for RGB colors, and multiplies the input image signal by the correction coefficients kR, kG, and kB before sending it to the display apparatus 100. Assuming that the corrected image-signal amplitude satisfies Expression (2) above, if the R signal is used as a reference for correction, the correction coefficients kR, kG, and kB are determined as below:

$$kR=1$$

$$kG=1.56$$

$$kB=1.14$$

In general, if one column control circuit unit is provided for one column, the following correction coefficients that are determined based on Expression (3) above are needed:

kR=1 kG=1.56 kB=2.28

In this case, a signal whose amplitude is twice or more times that of the original signal is to be generated. In the present invention, on the other hand, since two or more column control circuit units are provided for the color that requires the largest current, the necessary signal amplitude can be reduced, and the power supply voltage of the modifying circuit 32 can also be reduced.

If the characteristics of the column control circuits are uniform, the same coefficients can be used to perform a correction for other sets of RGB colors. However, due to the characteristic variations of the TFTs, the current outputs may vary between sets of RGB colors to cause visible non-uniformity in brightness.

One solution to this problem is proposed in U.S. Patent Laid-Open No. 2004-0183752. All outputs of the column control circuits are commonly connected to obtain a total sum current, and the value of the total sum current is detected by a detection circuit. The detected value can be used for the correction coefficients of the modifying circuit.

The modifying circuit 32 performs a calculation using a current signal detected for each set and a reference current signal, and obtains a correction coefficient for each set. The resulting correction coefficient is multiplied by the above-mentioned correction coefficient for each of RGB colors to obtain correction coefficients for each column.

A specific example of the remaining circuits will be described. In place of the circuits described herein, any well-known circuit having the above-mentioned capability may be used.

Figure 3:
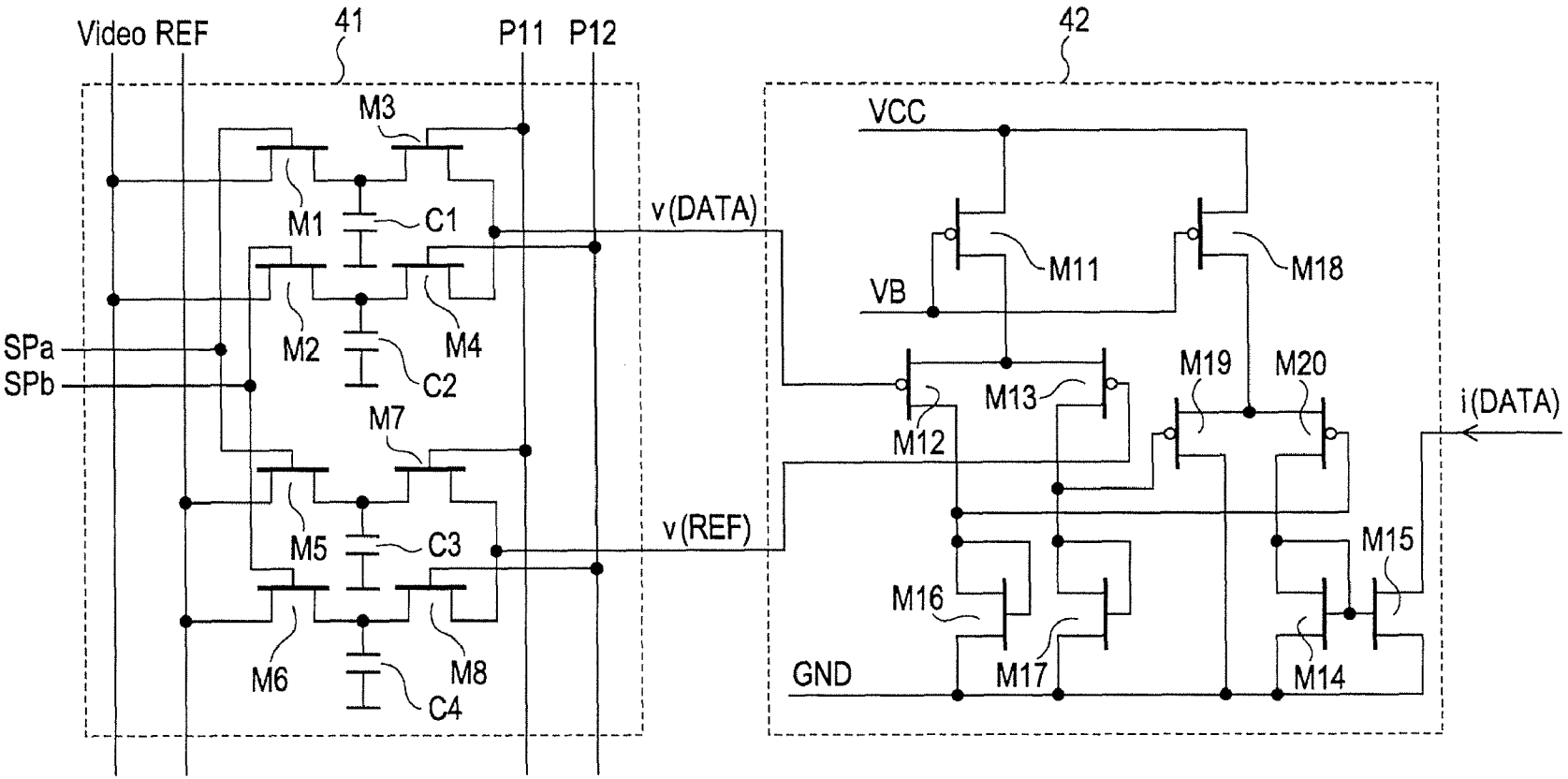
FIG. 3 is a diagram showing in detail the column control circuit according to the first embodiment.

FIG. 3 shows an example circuit of the column control circuit 1 of the first embodiment. The column control circuit 1 includes a sampling unit 41 and a voltage-current conversion unit 42. In the example shown in FIG. 3, the sampling unit 41 includes two circuit systems having a group of circuit elements with odd numbers such as transistors M1 and M3 and a group of circuit elements with even numbers such as transistor M2 and M4, and alternately performs sampling in response to sampling pulses SPa and SPb that are alternately input at every one horizontal synchronization Hsync.

First, when the sampling pulse SPa for the odd-numbered system is input, the transistors M1 and M5 are turned on, and an image signal Video and a reference signal REF are stored in capacitors C1 and C3, respectively. When the sampling of one horizontal line is finished, a control signal P11 supplied from the gate circuit 4 is input to turn on the transistors M3 and M7, and sampling data v(DATA) and v(REF) are delivered to the voltage-current conversion unit 42. An image signal Video for the subsequent line is input during this operation, and a similar operation is performed by the even-numbered circuit system in response to the sampling pulse SPb for the even-numbered system and a control signal P12.

In the voltage-current conversion unit 42, a current that is adjusted by a voltage VB is supplied from a transistor M11, and separately flows into transistors M12 and M13 according to the difference between the data v(DATA) and v(REF). The differential outputs outputted from the drains of the transistors M12 and M13 are processed by differential amplifiers M19 and M20 in the subsequent stage so as to have an increased linearity relative to the inputs. A current of the amplifier M20 is output as a current i(DATA) by a current mirror circuit formed of transistors M14 and M15.

Figure 4:
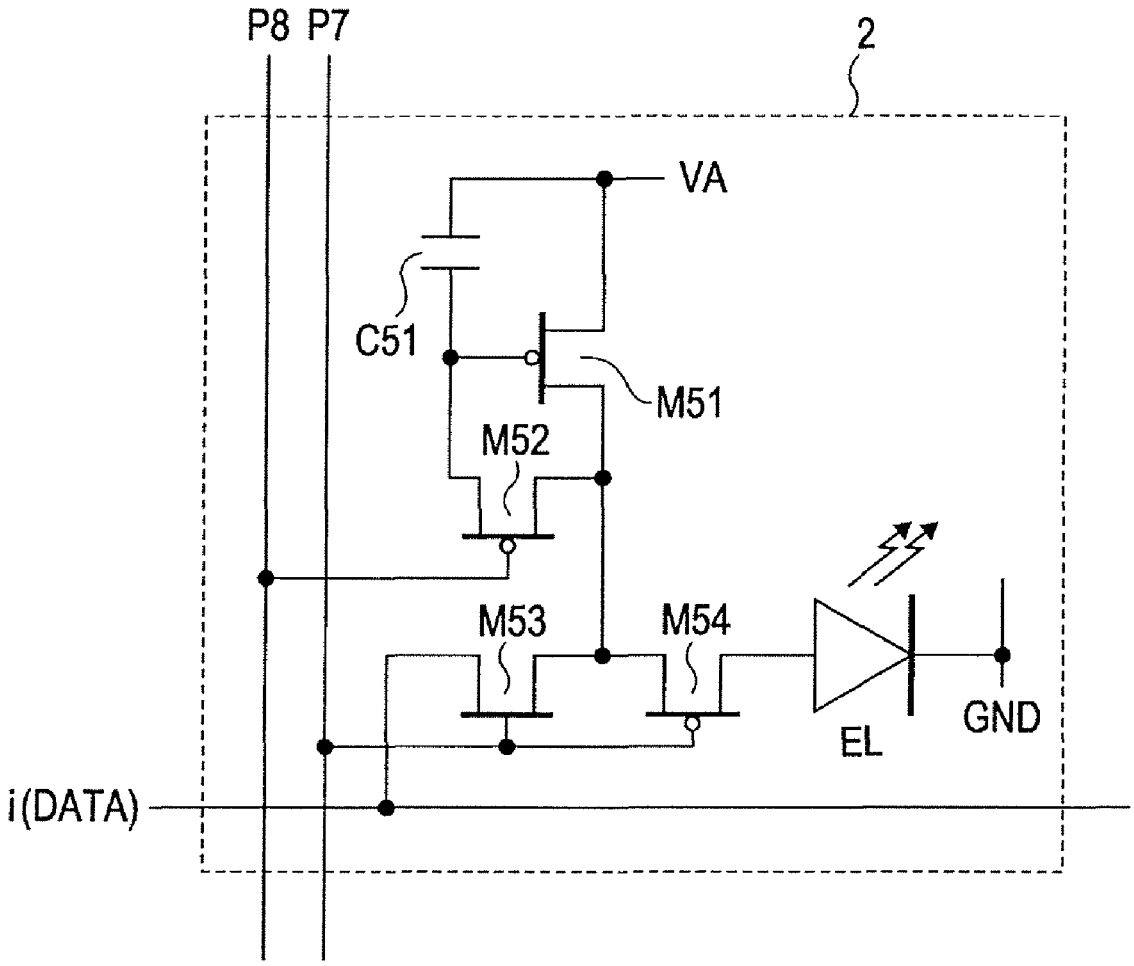
FIG. 4 is a diagram showing in detail a pixel circuit according to the first embodiment.

FIG. 4 shows an example of each of the pixel circuits 2. Scanning lines P7 and P8 are output from the scanning line driving circuit (row control circuit) 5 shown in FIG. 1, and two signal lines are provided for one row. Current data i(DATA) is output from the column control circuit 1 shown in FIG. 3. When one row is selected by the scanning lines P7 (high level) and P8 (low level), transistors M52 and M53 are turned on, and the current data i(DATA) flows from the data line to a capacitor C51 via the transistors M53 and M52 to charge the capacitor C51. When the charging is completed, a transistor M54 is turned on, and a current corresponding to the voltage of the capacitor C51 flows from a power supply VA to an EL device EL via a transistor M51.

Second Embodiment

Figure 5:
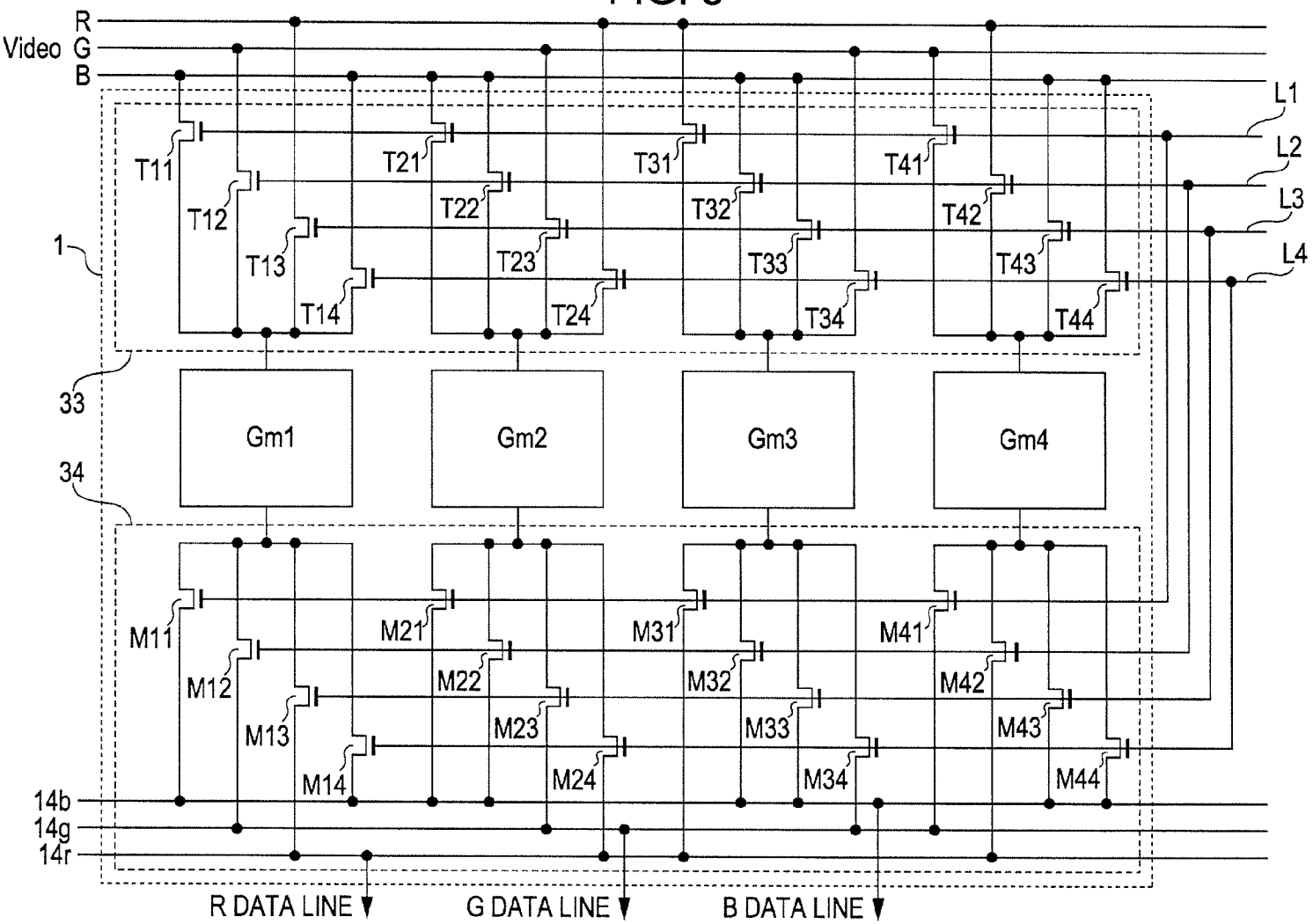
FIG. 5 is a diagram showing a structure of a set of column control circuit units in a column control circuit unit according to a second embodiment of the present invention.

FIG. 5 shows one set of column control circuit units in a column control circuit according to a second embodiment of the present invention.

As shown in FIG. 5, a column control circuit 1' of a display apparatus according to the second embodiment includes a set of four column control circuit units Gm1 to Gm4 and TFT circuits placed upstream and downstream of the column control circuit units Gm1 to Gm4.

The column control circuit 11 shown in FIG. 5 is different from the column control circuit 1 according to the first embodiment (see FIG. 2) in that an input image signal is not fixedly connected to the column control circuit units Gm1 to Gm4 but can be switched by a first switch 33 and that the output of the column control circuit 1' is not fixedly connected to the data line but can be switched by a second switch 34.

First, the operation of the first switch 33 will be described.

The first switch 33 includes a total of 16 TFTs T11 to T44 that connect three input image lines of RGB colors, namely, Video R, Video G, and Video B, and input terminals of the four column control circuit units Gm1 to Gm4. The TFTs T11 and the other TFTs individually function as switches to switchably connect between the input image lines Video R, Video G, and Video B and the column control circuit units Gm1, Gm2, Gm3, and Gm4 of the column control circuit 1'.

Source terminals of the TFTs T11 to T14, T21 to T24, T31 to T34, and T41 to T44 are connected to the three input image lines Video R, Video G, and Video B. In this connection, four TFTs select a set of three image signal lines Video R, Video G, and Video B in a manner that allows the image signal line Video B to be doubly selected, and the selections for the different column control circuit units are cyclically different.

Specifically, the source terminals of the TFTs T11, T12, T13, and T14 connected to the input terminal of the first column control circuit unit Gm1 are connected to the image signal lines Video B, Video G, Video R, and Video B, respectively. The source terminals of the TFTs T21, T22, T23, and T24 connected to the input terminal of the second column control circuit unit Gm2 are connected to the image signal lines Video B, Video B, Video G, and Video R, respectively. The source terminals of the TFTs T31, T32, T33, and T34 connected to the input terminal of the third column control circuit unit Gm3 are connected to the image signal lines Video R, Video B, Video B, and Video G, respectively. The source terminals of the TFTs T41, T42, T43, and T44 connected to the input terminal of the fourth column control circuit unit Gm4 are connected to the image signal lines Video G, Video R, Video B, and Video B, respectively.

Every four gate terminals of the TFTs are commonly connected, and on-off control signals L1, L2, L3, and L4 are supplied to control the opening and closing of the TFTs. The control signal L1 is connected to the gate terminals of the TFTs T11, T21, T31, and T41; the control signal L2 is connected to the gate terminals of the TFTs T12, T22, T32, and T42; the control signal L3 is connected to the gate terminals of the TFTs T13, T23, T33, and T43; and the control signal L4 is connected to the gate terminals of the TFTs T14, T24, T34, and T44.

Figure 6:
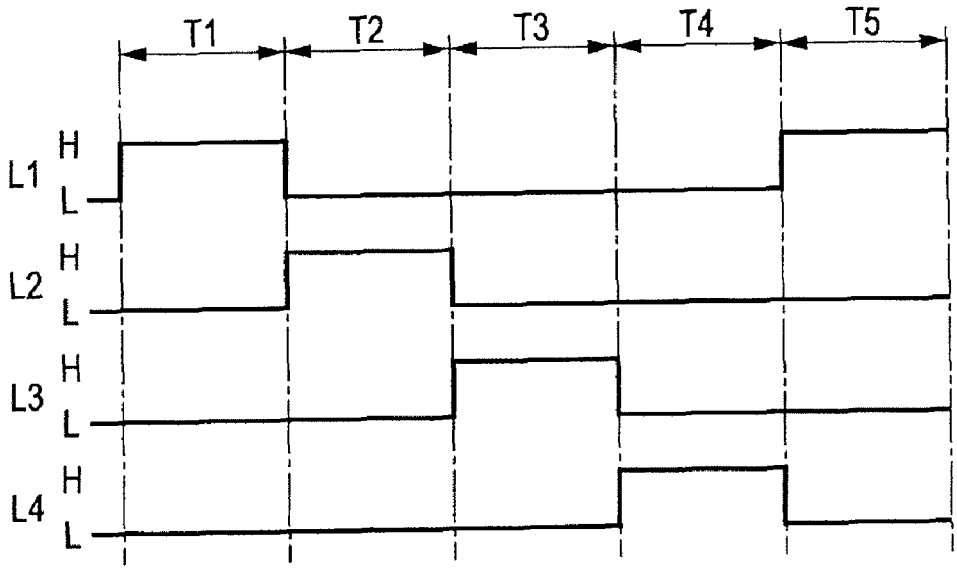
FIG. 6 is a timing chart showing the operation of the column control circuit according to the second embodiment.

The control signals L1 to L4 are output from the gate circuit 4 shown in FIG. 1 at a predetermined operation timing shown in FIG. 6.

In the timing chart shown in FIG. 6, the logic levels of the control signals L1 to L4 to be input to the gate terminals are illustrated. In synchronization with a horizontal synchronization signal Hsync, the control signals L1 to L4 are set to a high level for periods T1 to T4, respectively, and are repeated every four horizontal periods.

The first switch 33 shown in FIG. 5 performs the operation shown in Table 1 below. In Table 1, the number (No.) field represents the horizontal synchronization sequence number, the ON-TFT field represents the turned on transistors, and the Gm1 to Gm4 fields represent the input image signals to the column control circuit units Gm1 to Gm4, respectively.

TABLE 1

| No. | L1 | L2 | L3 | L4 | ON-TFT | Gm1 | Gm2 | Gm3 | Gm4 |
|---|---|---|---|---|---|---|---|---|---|
| T1 | H | L | L | L | T11, T21, T31, T41 | B | B | R | G |
| T2 | L | H | L | L | T12, T22, T32, T42 | G | B | B | R |
| T3 | L | L | H | L | T13, T23, T33, T43 | R | G | B | B |
| T4 | L | L | L | H | T14, T24, T34, T44 | B | R | G | B |

First, in the first horizontal line period T1, only the control signal L1 is high, and the control signals L2, L3, and L4 are low. At this time, the transistors T11, T21, T31, and T41 of the switch 33 are turned on, and the remaining transistors are turned off. In this state, the column control circuit units Gm1, Gm2, Gm3, and Gm4 are connected to the image signal lines Video B, Video B, Video R, and Video G, respectively.

In the second unit horizontal line period T2, only the control signal L2 is high, and the control signals L1, L3, and L4 are low. At this time, the transistors T12, T22, T32, and T42 are turned on, and the remaining transistors are turned off. In this state, the column control circuit units Gm1, Gm2, Gm3, and Gm4 are connected to the image signal lines Video G, Video B, Video B, and Video R, respectively, to which the image signal lines connected in the first unit horizontal line period T1 are shifted by one.

Subsequently, a similar operation is performed in the third and fourth periods T3 and T4, and the connections are cyclically shifted by one.

In the fifth period T5, a similar operation to that in the first period T1 is performed, and the above-described operation is repeatedly performed thereafter.

Then, the operation of the second switch 34 will be described.

The connections of TFTs in the second switch 34 are opposite to those in the first switch 33. The RGB input image signals assigned to the column control circuit units Gm1 to Gm4 are returned to the original state, that is, the current-data signals corresponding to input video signals for R, G, and B are supplied to the R, G, and B data lines, respectively. The timing of switching is synchronous with that of the first switch 33. The control signals L1 to L4, which are the same as those for the first switch 33, are used to control the TFTs in the second switch 34. The states of the control signals L1 to L4 in the unit horizontal line periods T1 to T4, the turned on TFTs (ON-TFT), and data lines 14*r*, 14*g*, and 14*b* connected to the output terminals of the column control circuit units Gm1 to Gm4 are shown in Table 2 below.

TABLE 2

| No. | L1 | L2 | L3 | L4 | ON-TFT | Gm1 | Gm2 | Gm3 | Gm4 |
|---|---|---|---|---|---|---|---|---|---|
| T1 | H | L | L | L | M11, M21, M31, M41 | b | b | r | g |
| T2 | L | H | L | L | M12, M22, M32, M42 | g | b | b | r |
| T3 | L | L | H | L | M13, M23, M33, M43 | r | g | b | b |
| T4 | L | L | L | H | M14, M24, M34, M44 | b | r | g | b |

As can be seen from Tables 1 and 2, in the four periods T1, T2, T3, and T4, the input of the column control circuit unit Gm1 is switchingly connected to the image signal lines Video B, Video G, Video R, and Video B in the order stated, and the output is switchingly connected to the data lines 14*b*, 14*g*, 14*r*, and 14*b* in the order stated. In this manner, the color of the input destination and the color of the output destination are always the same. The same applies to the column control circuit units Gm2 to Gm4. On each of the R, G, and B data lines, therefore, an input image signal of the corresponding color is correctly output as a current-data signal.

As described above, by switching the column control circuit units every predetermined period, the characteristic variations of the voltage-current conversion transistors in the column control circuit units Gm1, Gm2, Gm3, and Gm4 of one column of column control circuit can be distributed, and non-uniformity in display that appears as vertical fringes or the like can be reduced.

In a case where there is a larger difference in current-luminance efficiency between RGB devices, three or more column control circuit units may be provided for the color that requires the largest current. A plurality of column control circuit units may be assigned to not only a column of one color but also columns of two colors. The number of column control circuit units can be determined from a current ratio of the R, G, and B light-emitting devices for displaying correct white so that the correction coefficients of the image signals can be as close to 1 as possible in the manner described above.

Third Embodiment

A third embodiment of the present invention provides an electronic apparatus including the display apparatus according to each of the above-described embodiments.

Figure 7:
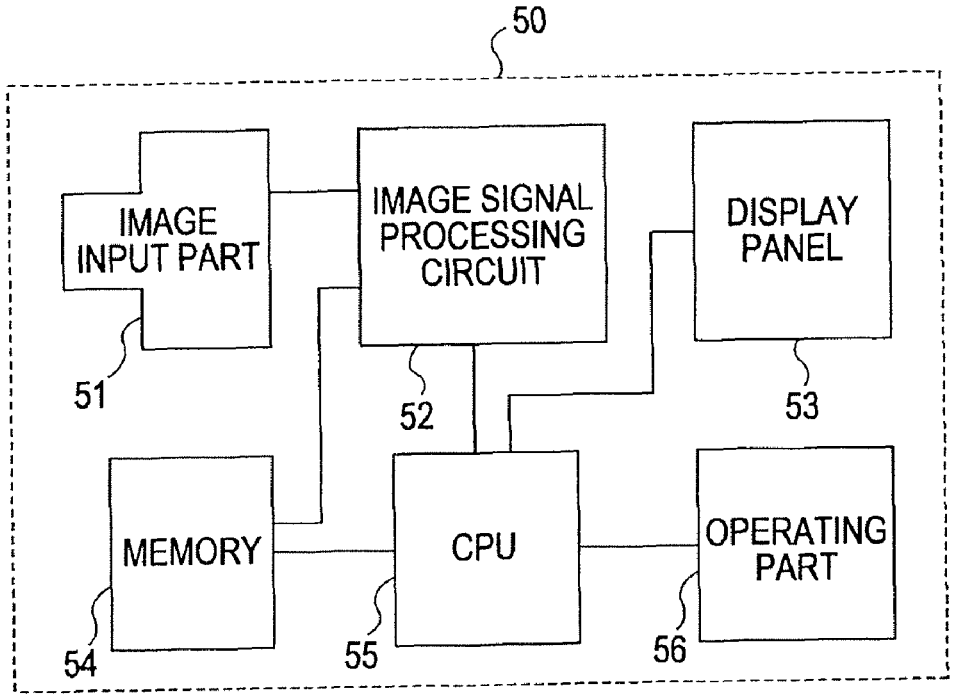
FIG. 7 is a block diagram showing an overall structure of a digital still camera system according to a third embodiment.

FIG. 7 is a block diagram showing an example of a digital still camera system 50 according to the third embodiment. In FIG. 7, the digital still camera system 50 includes an image input part 51, an image signal processing circuit 52, a display panel 53, a memory 54, a central processing unit (CPU) 55, and an operating part 56.

In FIG. 7, an image photographed by the image part 51 or an image recorded on the memory 54 is subjected to signal processing by the image signal processing circuit 52, and can be viewed on the display panel 53. The CPU 55 controls the image input part 51, the memory 54, the image signal processing circuit 52, and the like according to an input from the operating part 56 to perform photographing, recording, playback, and display suitable for the circumstance. The display panel 53 can also be used as a display part of any other electronic apparatus.

While the above-described embodiments have been described in the context of a display apparatus including EL devices, the present invention is not limited to those embodiments, and can be applied to current-driven display apparatuses such as a plasma display panel (PDP) and a field emission display (FED).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-297641 filed Oct. 12, 2005, which is hereby incorporated by reference herein in its entirety.

What is claimed is:

1. A display apparatus comprising:

a matrix display unit including light-emitting devices that emit light of one of a plurality of colors with a brightness corresponding to a current and pixel circuits that drive the light-emitting devices, the light-emitting devices and the pixel circuits being arranged in rows and columns;

a plurality of column control circuits that receive input image signals and generate and output current-data signals; and a plurality of data lines each provided for each column of the matrix display unit to transfer the current-data signal output from the column control circuit to one of the pixel circuits in the column, wherein the light-emitting devices have different current-luminance efficiencies depending on colors of emitted lights, wherein the plurality of data lines are divided into sets of data lines, each set of data lines transferring the current-data signals of the plurality of colors to the pixel circuits, and the number of data lines in the set of data lines being equal to the number of colors, wherein one set of the column control circuits, comprised of a number which is larger than a number of colors of the display unit, is provided for one set of the data lines, comprised of a number which is equal to the number of colors, and wherein the number of column control circuit units connected to the data line for transferring the current-data signal to the pixel circuit for driving the light-emitting device of a color having a smallest current-luminance efficiency among the data lines included in one set of the data lines in each of the data line sets and which output a sum of the current-data signals, is larger than the number of the column control circuits connected to the data line for transferring the current-data signal to the pixel circuit for driving the light-emitting device of a color having a largest current-luminance efficiency and which output the current-data signals.

2. The display apparatus according to claim 1, further comprising means for correcting an amplitude of the input image signals that are individually input for the plurality of colors.

3. The display apparatus according to claim 1, further comprising:

a first switch that switchably connects between the input image signals that are individually input for the plurality of colors and the sets of column control circuits; and a second switch that switchably connects between the sets of column control circuits and the sets of data lines, wherein the connection of the second switch allows the connection of the first switch to be returned to an original state.

4. The display apparatus according to claim 1, further comprising correcting means for detecting a sum of output currents of the column control circuits for each set of column control circuits and for correcting the input image signals input to the column control circuits for each set of column control circuits according to a difference between an average of the sum of output currents for all the sets of column control circuits and the sum of output currents for each set of column control circuits.

5. A digital camera comprising the display apparatus according to claim 1 as a display panel.

* * * * *